United States Patent [19]

Chou

[11] Patent Number: 4,541,185

[45] Date of Patent: Sep. 17, 1985

[54] GAME SHOE

[76] Inventor: Jin-Jong Chou, No. 8, Lane 37, Cheng Kung St., She Tou Hsiang, Taiwan

[21] Appl. No.: 535,648

[22] Filed: Sep. 26, 1983

[51] Int. Cl.[4] ..... A43B 5/00; A43B 7/06; A43B 13/20

[52] U.S. Cl. ..... 36/114; 36/28; 36/59 C; 36/7.6; 36/29

[58] Field of Search ..... 36/25 R, 28, 29, 32 R, 36/59 C, 8.1, 114, 103, 113, 7.6, 7.7; D2/320

[56] References Cited

U.S. PATENT DOCUMENTS

| | | | |
|---|---|---|---|
| D. 196,490 | 10/1963 | Papoutsy | D2/320 |
| D. 258,774 | 4/1981 | Denu | D2/320 |
| 1,389,416 | 8/1921 | Zertuche | 36/7.6 |
| 2,985,971 | 5/1961 | Murawski | 36/29 |
| 3,043,025 | 7/1962 | Semon | 36/59 C |
| 4,118,878 | 10/1978 | Semon | 36/59 C |
| 4,228,600 | 10/1980 | Krug et al. | 36/32 R |
| 4,372,058 | 2/1983 | Stubblefield | 36/32 R |

FOREIGN PATENT DOCUMENTS

| | | | |
|---|---|---|---|
| 26941 | 2/1977 | Japan | 36/32 R |

*Primary Examiner*—Werner H. Schroeder
*Assistant Examiner*—Steven N. Meyers
*Attorney, Agent, or Firm*—Knobbe, Martens, Olson & Bear

[57] ABSTRACT

A game shoe having a novel outsole which includes, a skirt adhesion member located on the bottom surface of the forepart of the outsole, first projections and second projections provided on the bottom surface of the rear-part of the outsole and the bottom surface surrounded by the skirt adhesion member. The first projections are cylindrical, different in size and are formed in such a manner that the greater the height is, the smaller the diameter will be. The second projections are provided with skirt adhesion bottom ends respectively to contact the floor surface.

9 Claims, 4 Drawing Figures

GAME SHOE

BACKGROUND OF THE INVENTION

The present invention is related to shoes, more particularly to a game shoe which features a novel outsole structure.

Many shoe soles have been advanced which attempt to provide maximum comfort, foot stability, light weight, shock absorption, etc., according to their types. In the sport fields, running shoe soles are aimed at achieving light weight, maximum foot stability and shock absorption, while the weighed shoe provides the exercising of the feet and legs.

SUMMARY OF THE INVENTION

An object of the invention is to provide a game shoe which has a novel outsole that can achieve enjoyment and is adapted to use on the flat surface, preferably smooth and clean surface.

Another object of the invention is to provide a game shoe which has a novel outsole that can provide athletic effect, like the exercising of the feet and legs.

The foregoing and other objects can be achieved in accordance with one aspect of the invention through the provision of a game shoe which comprises, an upper, and an outsole made of a resilient material and including first projections and second projections provided at the bottom side thereof at regular intervals, each of the second projections having a skirt like bottom end to contact the ground. Advantageously, the first projections are different in height and width, and are formed in such a manner that the greater the height is, the smaller the width will be.

In accordance with another apsect of the invention, the game shoe comprises, an upper, and an outsole made of a resilient material and including a skirt adhesion member located at the bottom surface of the forepart of the outsole. Advantageously, the skirt adhesion member is designed such that its periphery is greater than the width of the shoe. This skirt adhesion member of resilient material possesses an adhesion characteristic relative to the surface it contacts by suction. Therefore, the foot after set on the surface should apply a force against the adhesion to rise therefrom, thereby achieving the exercising of the feet and the legs for one who uses it.

The outsole may further include, first projections and second projections located at the bottom surface of the rear part of the outsole and at the forepart of the bottom surface surrounded by the skirt adhesion member. The first projections are different in height and width, and are formed in such a manner that the greater the height is, the smaller the width will be. Each of the second projections has a skirt like bottom end to contact the floor surface. When the wearer sets his foot on the floor surface, these skirt like bottom ends may create amusing sounds which can be of great interest for the children. Furthermore, the first projections of the outsole may also provide foot cushioning effect and shock dissipation.

These and other objects, features and advantages of the invention will be more apparent in the following description of a preferred embodiment with reference to the accompanying drawings, in which:

DETAILED DESCRIPTION OF THE PREFERRED EMBODIMENT

Figure 1:
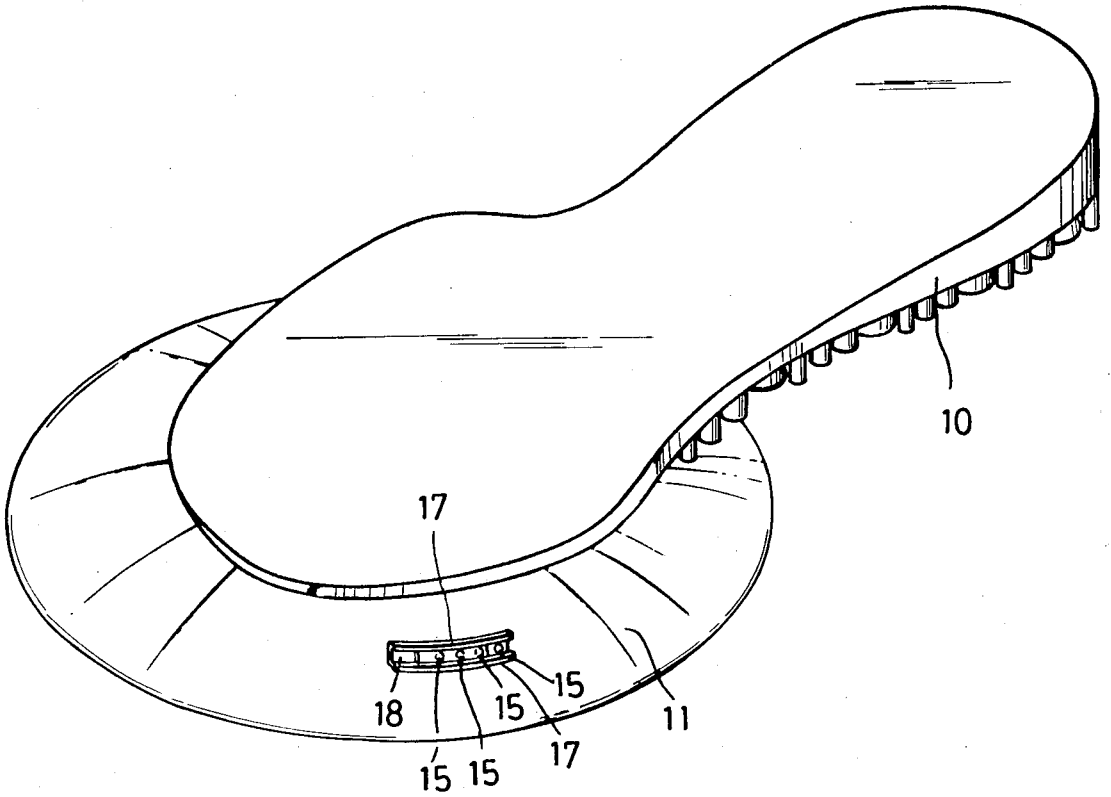
FIG. 1 is a perspective view of a game shoe constructed according to the invention.
Figure 2:
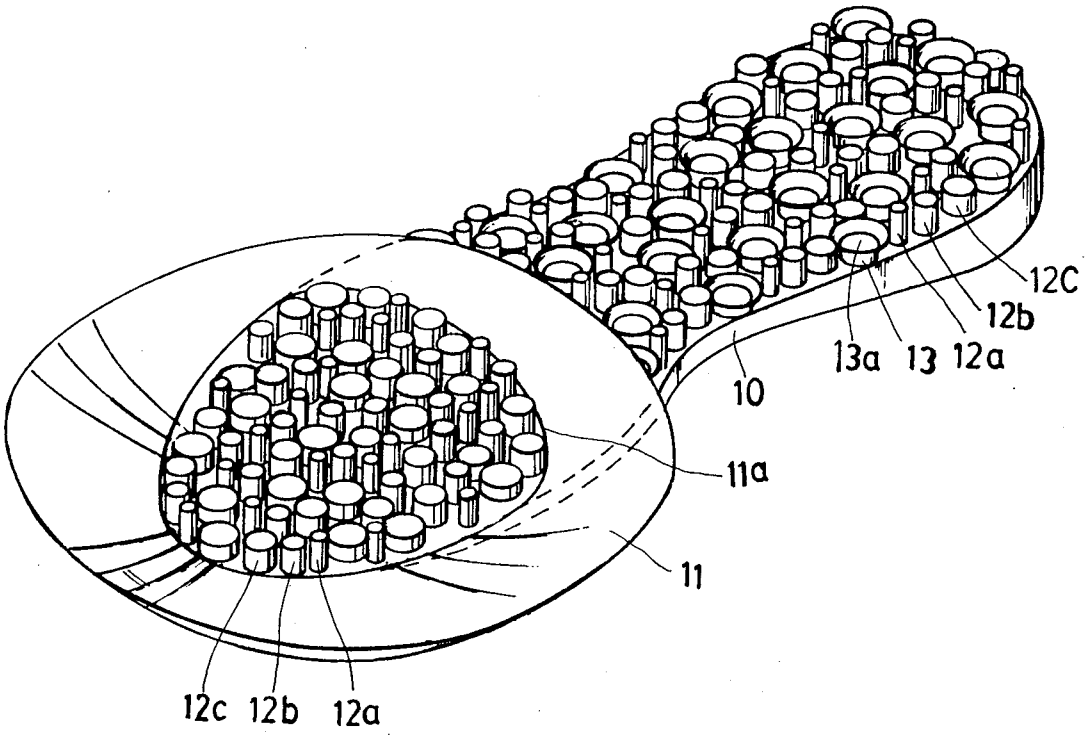
FIG. 2 is a perspective view of the game shoe in another position.
Figure 3:
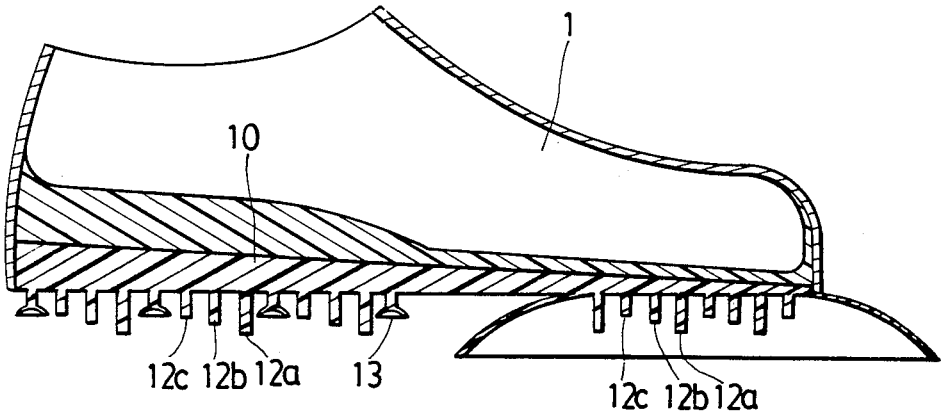
FIG. 3 is a sectioned view of the game shoe.
Figure 4:
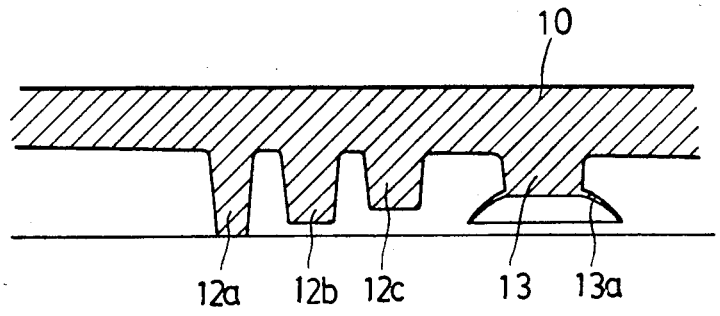
FIG. 4 is an enlarged view showing a portion of the game shoe.

Referring to FIGS. 1, 2 and 3, there is shown an outsole 10 which is to be coupled with an upper (not shown) and is made of a resilient material, such as plastics or rubber. The outsole 10 includes a skirt adhesion member 11 integrally formed therewith and located at the bottom surface of the forepart thereof, and height and periphery or diameter of the skirt adhesion member 11 being designed according to the adhesion force of the outsole desired. Preferably, the skirt adhesion member 11 are extended from the bottom surface along a looped line 11*a* which has a portion extending along the periphery of the toe portion of the outsole 10.

First projections 12*a*, 12*b* and 12*c* and second projections 13 are provided at predetermined regular intervals on the bottom surface of the rear part of the outsole 10. In the area surrounded by the looped line 11*a* only first projections 12*a*, 12*b* and 12*c* are provided. The first projections 12*a*, 12*b*, 12*c* are substantially cylindrical shapes and are different in height and width, the height becoming smaller from 12*a* to 12*c* and the diameter becoming greater from 12*a* to 12*c*. The second projections 13 are respectively provided with skirt adhesion bottom ends 13*a* to contact the floor. These bottom ends 13*a* will create amusing sounds when the foot rises against the adhesion to the floor surface.

As shown in FIG. 1, on the skirt adhesion member 11 is provided openings 15 which are spaced apart in an alignment. On both sides of the aligned openings 15 are provided two guide members 17 which cooperatively hold a shutter 18 that can be slided to open or close the openings 15. When the openings 15 are closed, the skirt adhesion member 11 may have its suction force up to many pounds according to the dimension of the adhesion member 11. If an opening 15 or all openings 15 are opened. The suction of the adhesion member 11 will disappear. Nevertheless, at the instance that the foot is set on the floor surface, there may be a suction in the skirt adhesion member 11 and the foot still must apply a force against the adhesion force when the wearer walks or exercises. It can be appreciated that the more the openings are opened, the smaller the adhesion force will be at the instance that the foot is set on the floor surface. Therefore, the player can adjust the adhesion of the outsole 10 to the floor, as required, by operating the shutter 18.

It can be noted from FIG. 3 that the thickness of the outsole 10 is tapered from the heel area to the toe portion and therefore, when the foot is set on the floor, the heel portion of the outsole 10 bears more load than elsewhere. Accordingly, the skirt adhesion member 11 will not readily wear out, thus increasing the service life thereof.

When the foot of the wearer is set on the surface, the first projections 12*a*, 12*b*, 12*c* of the outsole 10 will, one after the other, be compressed by the foot and dissipate the shock induced upon impact.

With the invention thus explained, it is apparent that obvious modifications and variations can be made without departing from the scope of the invention. It is therefore intended that the invention be limited only as indicated in the appended claims.

I claim:

1. A shoe sole comprising an outsole made of a resilient material and including first projections and second projections on the bottom side thereof, each of said second projections having a skirt adhesion bottom end to contact the floor surface, wherein:

said first projections are cylindrical and different in height and width; and said first projections are formed in such a manner that the greater the height, the smaller the width.

2. A shoe sole comprising an outsole made of a resilient material and including a skirt adhesion member surrounding a portion of the forepart of the bottom surface thereof, wherein said outsole further comprises first projections and second projections on the bottom surface of the rear part of said outsole and first projections on the portion of said bottom surface surrounded by said skirt adhesion member, each of said second projections having a skirt adhesion bottom end to contact the floor surface.

3. A shoe sole as claimed in claim 2, wherein said first projections are cylindrical and different in height and width.

4. A shoe sole as claimed in claim 3, wherein said first projections are formed in such a manner that the greater the height of said first projections, the smaller their width.

5. A shoe sole comprising an outsole made of a resilient material and including a first skirt adhesion member on the bottom surface of the forepart thereof, wherein said outsole further comprises first projections on the bottom surface of the rear part of said outsole and on the portion of the bottom surface surrounded by said first skirt adhesion member, and second projections on the bottom surface of said rear part of said outsole, each of said second projections having a skirt adhesion bottom end to contact the floor surface.

6. A shoe sole as claimed in claim 5, wherein said first projections differ in height and width.

7. A shoe sole as claimed in claim 6, wherein said first projections are formed in such a manner that those with greater height have smaller width.

8. A shoe sole as claimed in claim 5, wherein said first skirt adhesion member has a periphery greater than the width of said outsole.

9. A shoe outsole made of resilient material, said outsole including:

first projections on the bottom side thereof, wherein said first projections of different height have different widths, wherein said first projections of a first height have a first width, and said first projections of a second, shorter, height have a second, greater, width; and second projections on the bottom side of said outsole, each of said second projections having a skirt adhesion bottom end to contact the floor surface.

* * * * *